US006736491B2

(12) United States Patent
Okazawa et al.

(10) Patent No.: US 6,736,491 B2
(45) Date of Patent: May 18, 2004

(54) LIQUID JETTING HEAD AND METHOD OF MANUFACTURING THE SAME

(75) Inventors: Noriaki Okazawa, Nagano (JP); Takashi Osuga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/255,066

(22) Filed: Sep. 26, 2002

(65) Prior Publication Data

US 2003/0076385 A1 Apr. 24, 2003

(30) Foreign Application Priority Data

Sep. 26, 2001 (JP) ..... P2001-293249
Aug. 30, 2002 (JP) ..... P2002-253816

(51) Int. Cl.[7] ..... B41J 2/045
(52) U.S. Cl. ..... 347/68
(58) Field of Search ..... 347/68, 70–72; 29/890.1

(56) References Cited

U.S. PATENT DOCUMENTS 6,386,672 B1 * 5/2002 Kimura et al. ..... 347/18

FOREIGN PATENT DOCUMENTS

WO WO 98/57809 12/1998

* cited by examiner

*Primary Examiner*—Judy Nguyen
(74) *Attorney, Agent, or Firm*—Sughrue Mion, PLLC

(57) ABSTRACT

A fixing plate includes a first region and a second region. A vibrator assembly includes a plurality of piezoelectric vibrators, a drive electrode formed on each of the piezoelectric vibrators, and a common electrode formed commonly to the piezoelectric vibrators. The vibrator assembly is bonded onto the first region in a cantilevered manner. A sheet-shaped wiring board supplies a drive signal to the drive electrode and applies a bias potential which is higher than a ground potential to the common electrode. A controller IC controls the drive signal. The controller IC has a first face mounted on the wiring board, and a second face opposing to the first face in which a semiconductor surface is exposed. An insulating layer is interposed between the second region of the fixing plate and the second face of the controller IC.

4 Claims, 8 Drawing Sheets

LIQUID JETTING HEAD AND METHOD OF MANUFACTURING THE SAME

BACKGROUND OF THE INVENTION

The present invention relates to a liquid jetting head enabling to eject liquid in the state of droplet such as an ink jet recording head, a liquid crystal jetting head, a coloring material jetting head, etc., particularly to a head having a vibrator unit provided with a plurality of piezoelectric vibrators.

In the liquid jetting head enabling to eject droplet from a nozzle orifice by generating pressure fluctuation in liquid in a pressure chamber, there is an ink jet recording head discharging ink drops used for an image recording apparatus or the like. Recently, the head is applied for every kind of industrial equipment in view of an advantage that very little liquid can be ejected accurately. For example, the head is applied for a liquid jetting head enabling to eject liquid crystal, a coloring material jetting head enabling to eject coloring material for filter, an electrode material jetting head enabling to eject electrode material becoming an electrode, a bio-organic substance jetting head enabling to eject a bio-organic substance, a micro pipette (a sample jetting head) enabling to eject a very little sample accurately, and so on.

In the various kinds of types of such the liquid jetting head, there is a type wherein liquid droplets are ejected by expanding or contracting piezoelectric vibrator. For example, 30–200 pieces of piezoelectric vibrators are arranged for each nozzle row. In a practical use, a plurality of piezoelectric vibrators are integrated as a unit to improve assembling efficiency. This vibrator unit comprises a vibrator assembly in which a plurality of piezoelectric vibrators are formed in a pectinated manner, a fixing plate on which the vibrator assembly is bonded, and a wiring board for supplying power to the respective piezoelectric vibrators. As the piezoelectric vibrator, there is preferably adopted a laminated type vibrator in which common electrodes and drive electrodes are alternately laminated while sandwiching a piezoelectric material. The laminated type vibrator extends or contracts in accordance with a potential difference between the drive electrode and the common electrode. In this respect, the common electrodes are grounded while the potential of the drive electrode in each of the vibrators is controlled by applying a drive signal. The fixing plate is a plate member for receiving the kinetic energy of the vibrators. Metal plate such as stainless steel is preferably adopted in view of the stiffness and the heat radiating property.

The common electrodes and the wiring board are electrically connected via an external common electrode formed on an outer face of the vibrator assembly. When the vibrator assembly is bonded on the fixing plate, the external common electrode and the fixing plate may be directly contacted with each other at a portion where an adhesive is not interposed therebetween. In such a case, the potential of the fixing plate becomes the same as that of the common electrodes.

As the wiring board, a flexible sheet type one is preferably adopted. To efficiently use limited spaces, a controller IC for controlling the driving of the piezoelectric vibrators is provided on a surface of the wiring board. To facilitate insertion operation of the wiring board into a head case, and to enhance the heat radiation property, the controller IC is bonded onto the fixing plate as disclosed in PCT International Publication No. WO98/57809.

To make the liquid jetting head compact, the thinner controller IC is preferable. Specifically, it is preferable that the thickness of the controller IC is thinner than the thickness of the vibrator assembly. To reduce the thickness of the controller IC, a face opposite to a face of the controller IC mounted on the wiring board is abraded. That is, only the mounted section is molded and an oxide film in the abraded side is removed. The abraded face is bonded to the fixing plate.

In this case, there is a possibility that the abraded face and the fixing plate are conducted with each other. For example, in a case where the controller IC is pressed against the fixing plate in a condition that the adhesive is not solidified, the abraded face and the fixing plate may directly contact with each other while pushing aside the unsolidified adhesive. Accordingly, there is possibility that the common electrodes of the vibrators and the fixing plate are conducted with each other through the abraded face of the controller IC.

However, since the common electrodes are grounded, there is no considerable problem even if the common electrodes and the abraded face of the controller IC through the fixing plate.

Incidentally, insulating resistance of the piezoelectric material possibly falls by long use of the piezoelectric vibrator. When the insulation fault generates, the drive electrodes and the common electrodes in the vibrators are happened to be conducted with each other, so that the potential of the drive electrode falls down to the ground potential. In this state, when high potential driving signal is supplied to eject liquid drop, the volume and the speed of expansion and contraction of the piezoelectric vibrator become large inordinately, so that liquid drop is ejected unexpectedly.

In order to prevent such an accidental ejection, it is considered that constant bias potential which is higher several V to ten and several V than the ground potential and lower than intermediate potential is applied to the common electrode. In this case, since the potential of the drive electrode falls to at (east the bias potential even if insulation fault generates, the accidental liquid drop ejection can be prevented.

However, in a case where the common electrodes and the abraded face of the controller IC are conducted through the fixing plate under a condition that the bias potential is applied to the common electrodes, the bias potential is applied to the abraded face of the controller IC. Accordingly, fault and malfunction of the controller IC may be caused.

SUMMARY OF THE INVENTION

It is therefore an object of the present invention to provide a structure of liquid jetting head in which insulation of the fixing plate and the controller IC can be surely attained, and manufacturing efficiency is improved.

In order to achieve the above object, according to the present invention, there is provided a liquid jetting head, comprising:

- a fixing plate, including a first region and a second region;
- a vibrator assembly, including a plurality of piezoelectric vibrators, a drive electrode formed on each of the piezoelectric vibrators, and a common electrode formed commonly to the piezoelectric vibrators, the vibrator assembly bonded onto the first region in a cantilevered manner;
- a sheet-shaped wiring board, which supplies a drive signal to the drive electrode and applies a bias potential which is higher than a ground potential to the common electrode;

a controller IC, which controls the drive signal, the controller IC having a first face mounted on the wiring board, and a second face opposing to the first face in which a semiconductor surface is exposed; and an insulating layer, interposed between the second region of the fixing plate and the second face of the controller IC.

In this configuration, the controller IC can be surely prevented from charging the bias potential even if the common electrode contacts the fixing plate. Therefore, fault and malfunction of the controller IC can be surely avoided.

Preferably, the insulating layer is a resin film formed on the second region of the fixing plate. In this case, an extremely thin insulating layer can be easily formed.

Here, it is preferable that the resin film is formed by an adhesive used for bonding the vibrator assembly and the fixing plate. In this case, the resin film can be formed when the vibrator assembly is bonded on the fixing plate.

To easily obtain the insulating layer, the insulating layer may be a resin sheet adhered on the second face of the controller IC.

According to the present invention, there is provided a manufacturing method of a liquid jetting head, comprising:

providing a fixing plate, including a first region and a second region;

providing a vibrator assembly including a plurality of piezoelectric vibrators;

providing a sheet-shaped wiring board on which a first face of a controller IC is mounted;

exposing a semiconductor surface at a second face of the controller IC opposing to the first face;

coating an insulating adhesive on the first region of the fixing plate;

coating an insulating adhesive at least one of the second region of the fixing plate and at least a part of the second face of the controller IC;

placing the vibrator assembly onto the first region;

placing the second face of the controller IC onto the adhesive on the second region of the fixing plate; and solidifying the adhesive on the first region and the adhesion on at least one of the second region and the second face to bond the vibrator assembly and the controller IC onto the fixing plate.

In this method, the manufacturing can be efficiently performed because the insulating layer can be formed between the controller IC and the fixing plate while the vibrator assembly is bonded onto the fixing plate.

When the adhesive is coated on a part of the second face of the controller IC, the adhesive can be selectively applied on a desired portion so that the coating amount of the adhesive may be managed roughly to improve the manufacturing efficiency. Especially when a photocuring adhesive is adopted, such an adhesive may be selectively coated on a portion to which light such as ultraviolet light is irradiated so that the coated adhesive can be surely cured without remaining uncured portions.

Preferably, the semiconductor surface is exposed by abrading the second face of the controller IC.

According to the present invention, there is also provided a manufacturing method of a liquid jetting head, comprising:

providing a fixing plate, including a first region and a second region;

providing a vibrator assembly including a plurality of piezoelectric vibrators;

providing a sheet-shaped wiring board on which a first face of a controller IC is mounted;

exposing a semiconductor surface at a second face of the controller IC opposing to the first face;

coating an insulating adhesive on the first region and the second region of the fixing plate;

placing the vibrator assembly onto the first region;

solidifying the adhesive on the first region and the adhesion on the second region;

coating an adhesive at least one of the vibrator unit and the flexible cable;

placing the wiring board onto the vibrator unit while placing the second face of the controller IC onto the solidified adhesive on the second region of the fixing plate; and solidifying the adhesive interposed between the vibrator unit and the flexible cable.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the invention will be described below with reference to the accompanying drawings. The following description is referred to an ink jet recording head (hereinafter, simply referred as a recording head) which is a kind of a liquid jetting head. The ink jet recording head is incorporated in an image recording apparatus such as a printer, a plotter, a facsimile, and the like, to eject ink drops from a nozzle orifice.

Figure 1:
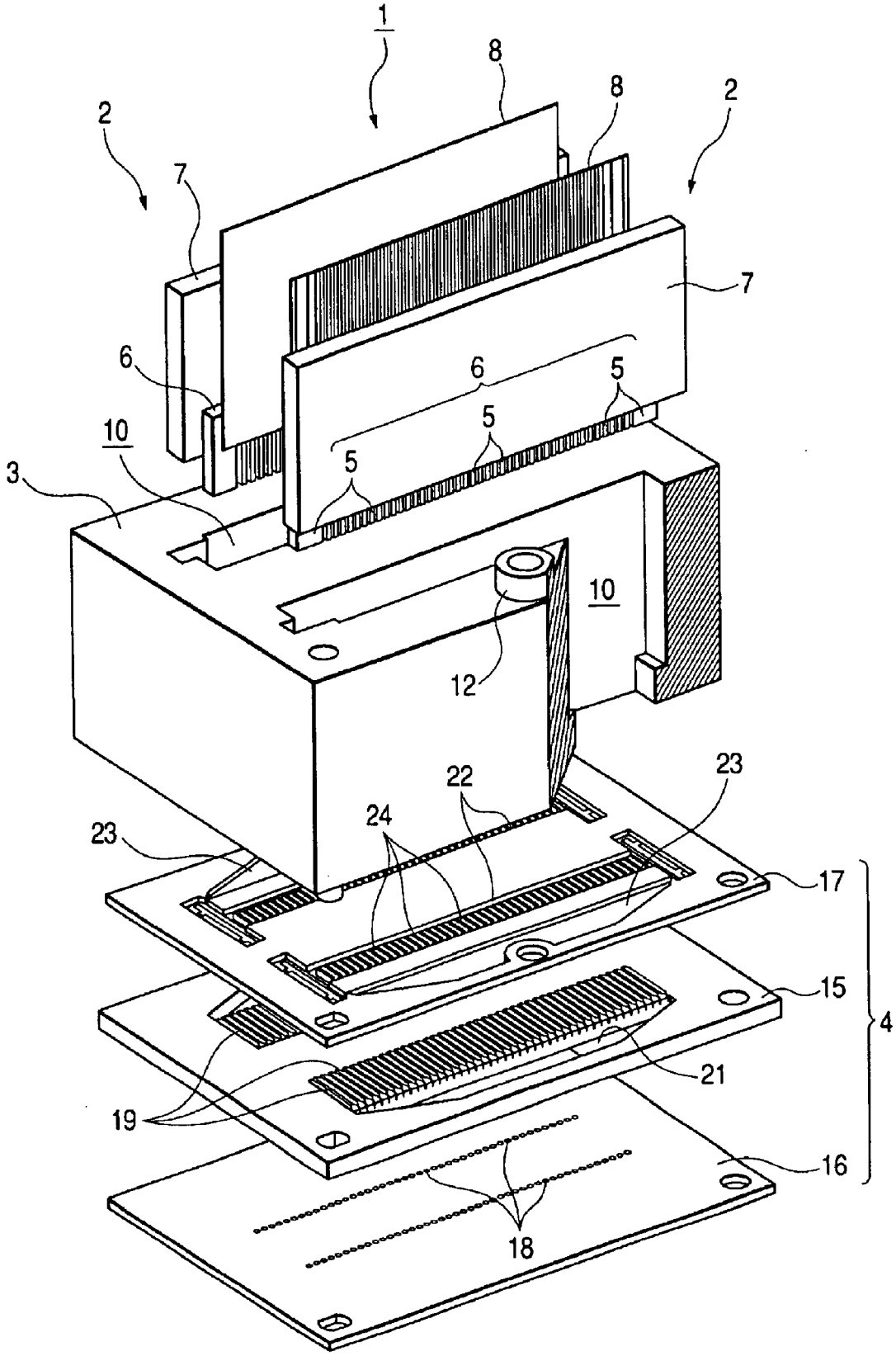
FIG. 1 is a decomposed perspective view of a liquid jetting head according to one embodiment of the invention.

As shown in FIG. 1, a recording head 1 comprises a pair of vibrator units 2, a resin case 3 for storing the vibrator units 2, a channel unit 4 joined to the case 3.

Figure 2:
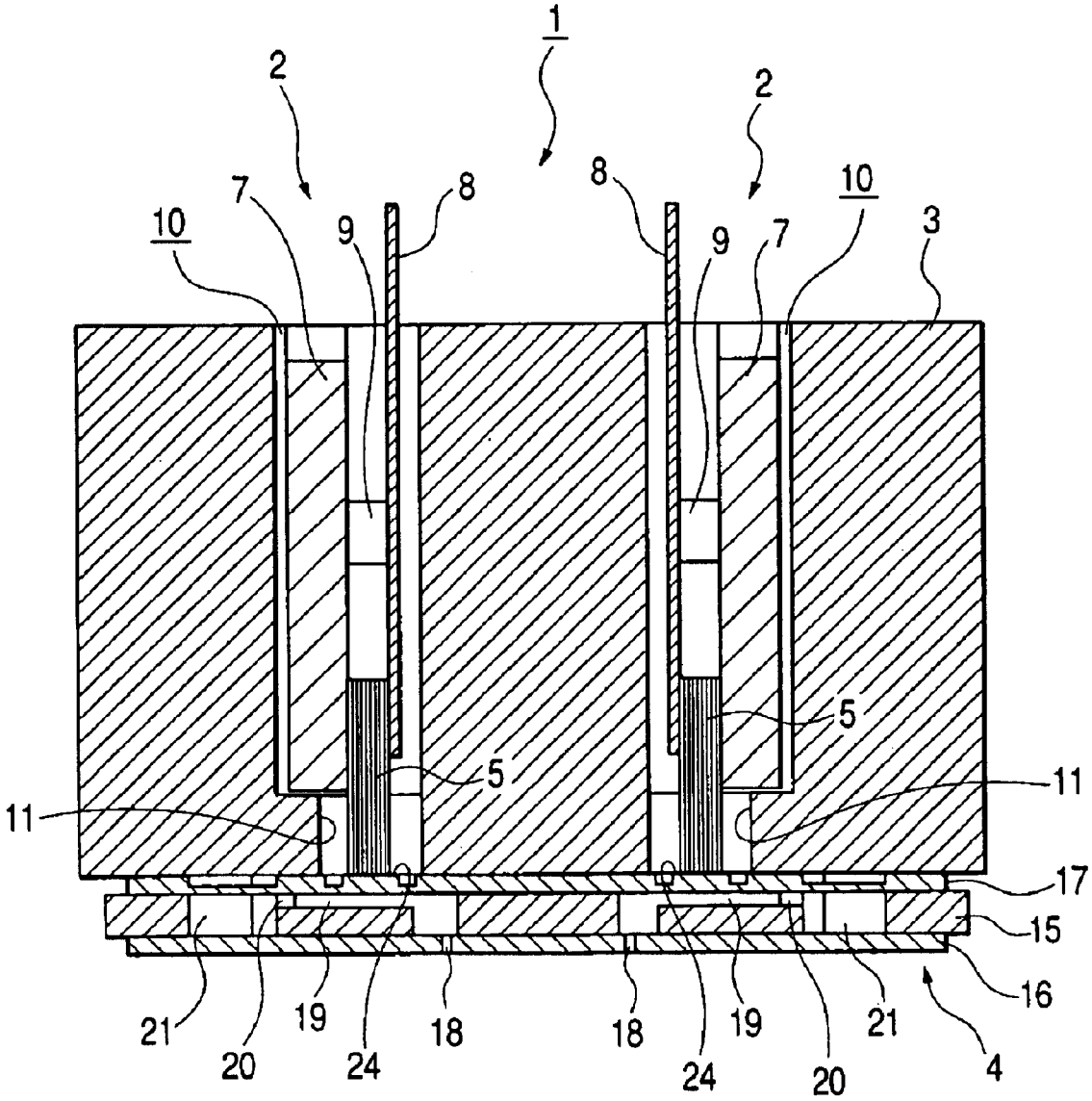
FIG. 2 is a sectional view of the liquid jetting head.
Figure 3:
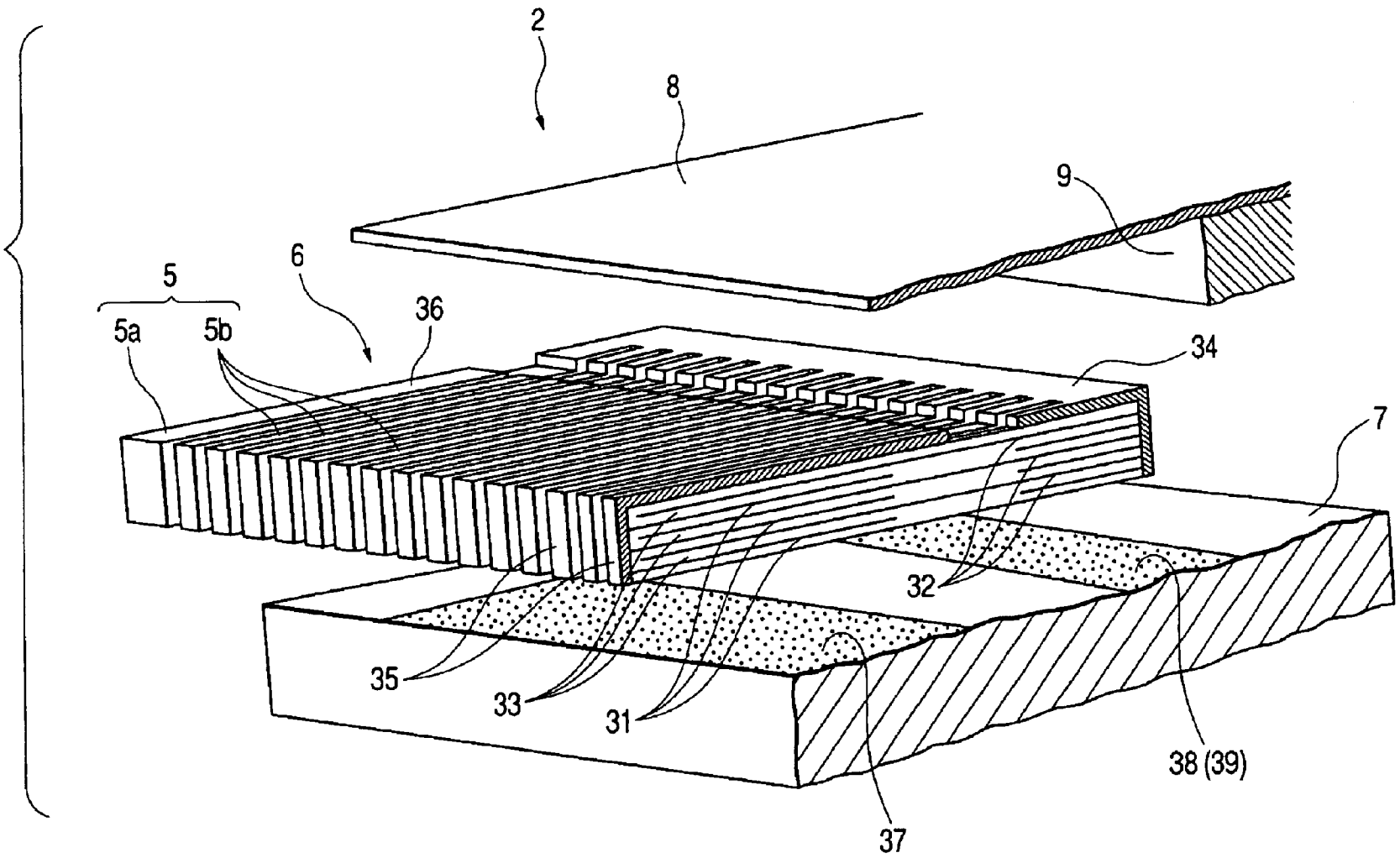
FIG. 3 is a decomposed perspective view of a vibrator unit in the liquid jetting head.

As shown in FIGS. 2 and 3, the vibrator unit 2 comprises: a vibrator assembly 6; a fixing plate 7 on which the vibrator assembly 6 is bonded; and a flexible cable 8 for supplying bias potential and driving signal to the vibrator assembly 6. The respective vibrators 5 are fixed on the fixing plate 7 in a cantilevered manner. Specifically, one end portion of each vibrator 5 is bonded onto the fixing plate 7 and the other end portion thereof is protruded from the fixing plate 7 as a free end. For the fixing plate 7, a plate-shaped member having higher rigidity than the resin forming the case 3, enabling to receive reaction from the piezoelectric vibrators and superior in heat radiation is preferably used. For example, it is constructed by a metal plate member such as a stainless steel plate. The flexible cable 8 is provided on a face in the fixed end side of the vibrators 5 opposing to the face joined to the fixing plate to be electrically connected to the vibrators 5. A controller IC 9 is mounted on a surface of the flexible cable 8. The details of the vibrator unit 2 will be described later.

The case 3 has a rectangular block-shaped appearance formed with a chamber 10 for accommodating the vibrator units 2. In this embodiment, the case 3 is made of epoxy resin which is a kind of thermosetting resin Since this kind of thermosetting resin has greater stiffness than the general resin, vibration generated from the driving vibrator 5 can be sufficiently received. Further, since this kind of thermosetting resin has a smaller coefficient of linear expansion, deformation caused by environmental temperature change can be suppressed.

The channel unit 4 is joined onto one end face of the case 3, while the other end face opposing to the one end face serves as a mounting face to be mounted on a carriage assembly. The chamber 10 penetrates the case 3 so as to communicate these end faces. The size of the chamber 10 is so determined that the vibrator unit 2 can be fitted thereinto. In the channel unit-side of the chamber 10, as shown in FIG. 2, a step 11 is formed so that the free end-side face of the fixing plate 7 is bonded thereon.

The case 3 is provided with an ink supply passage 12 for leading ink from an ink cartridge (not shown) to the channel unit 4. The ink supply passage 12 is so formed as to penetrate the case 3 in the vicinity of the chamber 10.

To form the channel unit 4, a nozzle plate 16 is placed to one main face of a channel forming substrate 15, and an elastic plate 17 is placed to the other main face of the channel forming substrate 15. The laminated members are integrated by bonding or the like. The nozzle plate 16 is a thin stainless steel plate in which nozzle orifices 18 are formed and arranged with a pitch corresponding to the dot recording density. In this embodiment, 96 nozzle orifices are arranged with a pitch of 180 dpi to form a nozzle row.

In the channel forming substrate 15, spaces to be pressure chambers 19 and ink supply ports 20 (see FIG. 2) are formed in association with the respective nozzle orifices 18, and spaces to be reservoirs 21 are formed in association with the respective nozzle rows. In this embodiment, the channel forming substrate 15 is fabricated by etching a silicon wafer.

Each pressure chamber 19 is a chamber elongated in a direction perpendicular to the extending direction of the nozzle row, and separated from adjacent chambers by partition walls. Each ink supply port 20 is also formed by the partition walls as a narrowed channel. Each reservoir 21 is communicated with the respective pressure chambers 19 via the respective ink supply ports 20, and communicated with the ink cartridge (not shown) via the ink supply passage 12. Accordingly, each reservoir 21 serves as a chamber for storing ink supplied from the ink cartridge to the respective pressure chambers 19.

The elastic plate 17 is a two-layers member in which an insulative elastic film is laminated on a conductive supporting plate. For the elastic film, resin film is used, more specifically, a film made of PPS (polyphenylene sulphide) is used. In the elastic plate 17, a compliance region 23 and a diaphragm region 22 are formed by removing the supporting plate partly so as to remain the elastic film by etching process and the like. The compliance region 23 is a part sealing one opening face of the space to be each reservoir 21, and the diaphragm region 22 is a part sealing one opening face of the space to be each pressure chamber 19.

The vibrator unit 2 is inserted into the chamber 10 from the carriage-side end face of the case 3, in a state that the free end portions of the vibrator assembly 6 are directed to the channel unit 4. When the vibrator unit 2 is then bonded to the chamber 10, the tip end faces of the piezoelectric vibrators 5 are bonded to the respective associated island portions 24. Further, a face opposite to the face on which the vibrator assembly 6 is fixed is bonded onto an inner wall face of the case 3 which defines the chamber 10. In this state, when the drive signal is applied through the flexible cable 8, the vibrators 5 extends or contracts to vary the volume of the pressure chamber 19. Specifically, when the vibrator 5 contracts in the longitudinal direction thereof, the island portion 24 is pulled toward the vibrator unit 2, so that the pressure chamber 19 is expanded. On the other hand, when the vibrator 5 extends, the island portion 24 is pushed toward the pressure chamber 19 to contract the same. Pressure fluctuation is generated in the ink in the pressure chamber 19 due to the volume change of the pressure chamber 19. That is, the ink is compressed by the contraction of the pressure chamber 19, and is decompressed by the expansion of the pressure chamber 19. Utilizing the pressure fluctuation, ink drops can be ejected from the nozzle orifices 18.

Figure 4:
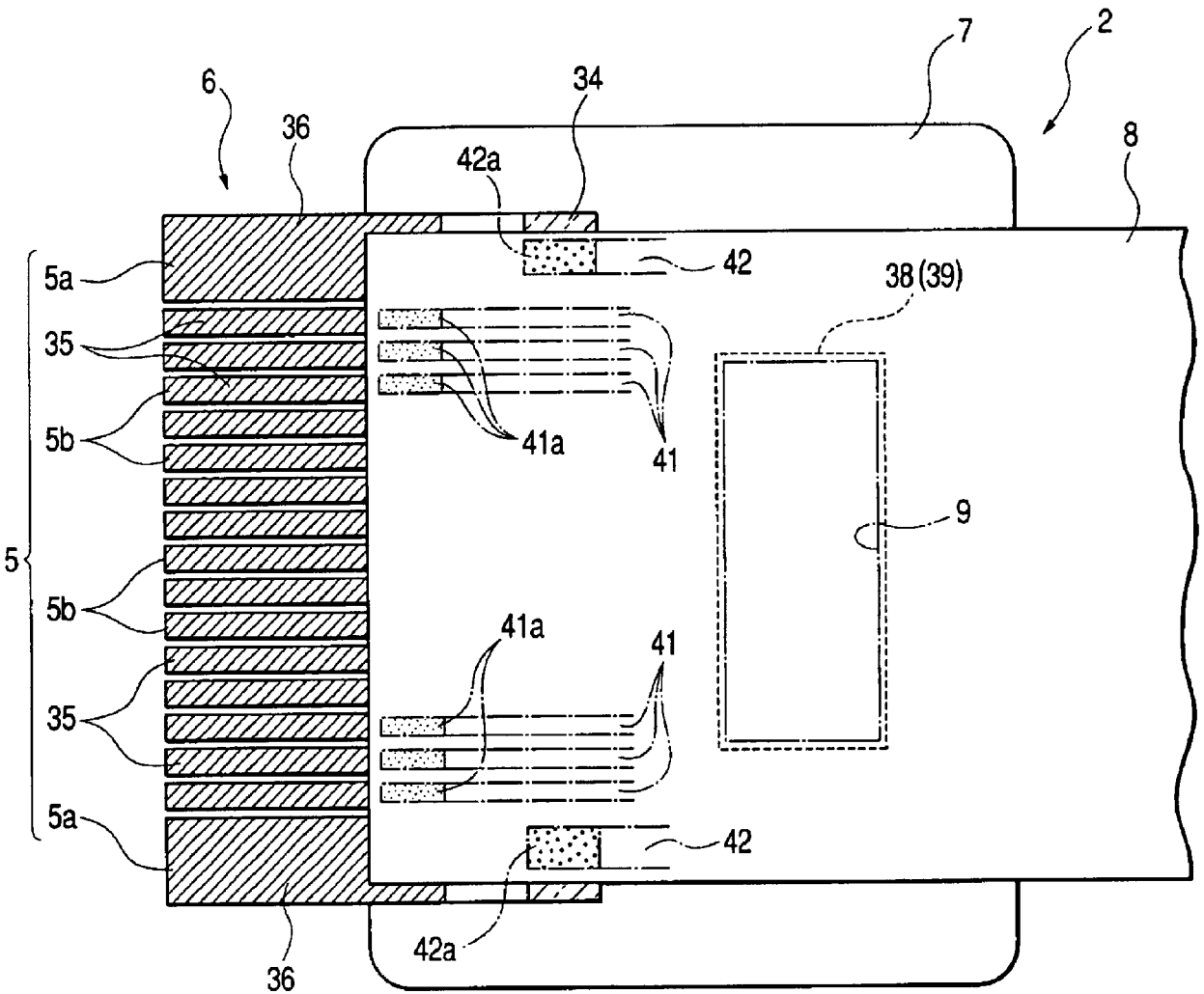
FIG. 4 is a plan view of the vibrator unit.

The details of the vibrator unit 2 will be described. As shown in FIGS. 3 and 4, the vibrator assembly 6 is constructed by a pair of dummy vibrators 5*a* placed at both side ends of the assembly and plural driving vibrators 5*b* arranged between these dummy vibrators 5*a*. The driving vibrator 5*b* is a piezoelectric vibrator expanding and contracting by supply of driving signal and is pectinated so as to have very thin width of about 50 to 100 $\mu$m so that vibrators of 96 pieces are provided in total. The dummy vibrator 5*a* is a piezoelectric vibrator not expanding and contracting, has sufficiently wider width than the driving vibrator 5*b* to serve also as a protector which protects the driving vibrator 5*b* from shock or the like, and also as a guide member for positioning the vibrator unit 2 to the predetermined position. The thickness of the vibrator assembly 6, that is the thicknesses of the dummy vibrators 5*a* and the driving vibrators 5*b* is so selected as to be 0.4 to 0.5 mm The driving vibrator 5*b* is a laminating type piezoelectric vibrator laminating drive electrodes 31 and common electrodes 32 alternately while sandwiching a piezoelectric material 33. The piezoelectric vibrator is of a longitudinal vibration type enabling to expand and contract to longitudinal directions thereof which is perpendicular to the laminating direction thereof. At outer side face of each driving vibrator 5*b*, a driving external electrode 35 and a common external electrode 34 are formed. The common external electrode 34 extends from the fixed-end face to the face opposing to the fixing plate 7 (that is, the face on which the flexible cable 8 is provided) of each vibrators 5, so as to have an L-shaped cross section. The common electrodes 32 are conducted with the common external electrode 34 at the fixed-end face. On the other hand, the common external electrode 32 extends in a direction that the vibrators 5 are arranged so that also the common electrodes 32 in the dummy electrodes 5*a*. The drive electrodes 31 in each driving vibrator 5*b* are conducted with the driving external electrode 35 at the free end face thereof. The driving external electrode 35 extends to the face on which the flexible cable 8 is placed so as to oppose to the common external electrode 34 with a gap therebetween.

Figure 5:
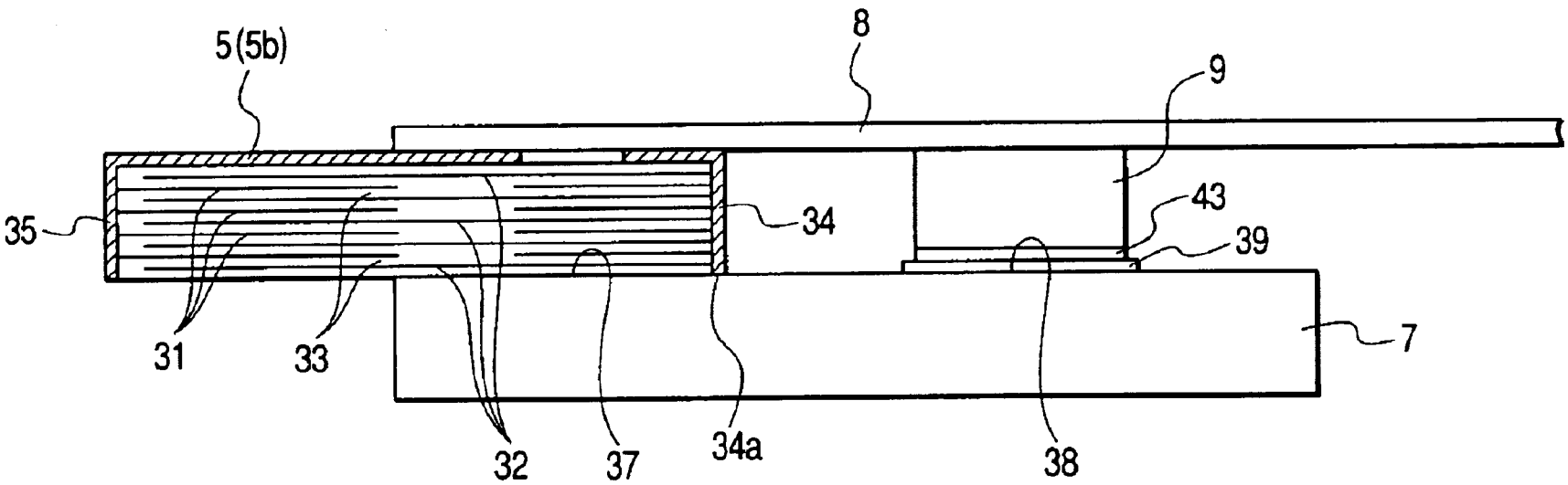
FIG. 5 is a side view of the vibrator unit.

Since the common external electrode 34 is formed so as to cover the whole of the fixed-end faces of the vibrators 5, there is possibility that the common external electrode 34 contacts the fixing plate 7 when the fixed end portions of the vibrators 5 are fixed on the fixing plate 7. For example, as shown in FIG. 5, an edge 34*a* of the common external electrode 34 may contact the surface of the fixing plate 7 at a portion where the adhesive is not interposed, so that the fixing plate 7 charges the bias potential. Therefore, the common electrodes 32 may conduct with the fixing plate 7 via the common external electrode 34 when the vibrators 5 are bonded onto the fixing plate 7.

Although the structure of the dummy vibrator 5*a* is similar as the driving vibrator 5*b*, it differs from the driving vibrator that supplying source of potential is not connected to the corresponding electrode 36 to the drive electrode 31 and driving external electrode 35. That is, in the dummy vibrator 5*a*, the electrode 36 serves as a floating electrode and conductor of the flexible cable 8 is not connected. On the other hand, a conductor for supplying the bias potential is connected to the common external electrode 34. Because of that, potential difference applied to each piezoelectric material 33 constructing the dummy vibrator 5*a* becomes constant so that the dummy vibrator 5*a* does not expand or contract.

In this embodiment, a stainless steel plate having 0.7 to 1.0 mm thickness is adopted as the fixing plate 7. On one face of the fixing plate 7, a vibrator bonding region 37 and an IC bonding region 38 are provided. The vibrator bonding region 37 is a region on which a fixed end portion of the vibrator assembly 6 is bonded. The IC bonding region 38 is separated from the vibrator bonding region 37 to provide a region on which an abraded face of the controller IC 9 is bonded. As shown in FIGS. 4 and 5, the IC bonding region 38 is a rectangular region having a larger area than the abraded face of the controller IC 9. A resin film 39 is disposed on the IC bonding region 38. The resin film 39 is an extremely thin film uniformly formed by the same adhesive as the one for bonding the vibrators 5 onto the fixing plate 7.

As shown in FIG. 4, the flexible cable 8 is a sheet-shaped wiring board including drive conductors 41 for supplying the drive signal and a pair of common conductors 42 for supplying the bias potential. The conductors 41 and 42 are covered with an insulating sheet. The number of the drive conductors 41 is the same as that of the drive vibrators 5*b*, and the arranging pitch of the drive conductors 41 is the same as that of the drive vibrators 5*b*. The common conductors 42 are placed both side ends of the drive conductors 41 in association with the position of the dummy vibrator 5*a*. Only tip ends of the conductors 41 and 42 are exposed from the insulating sheet to serve as contact points 41*a* and 42*a* with respect to the vibrators 5.

The contact point 41*a* of each drive conductor 41 is electrically joined to an associated one of the driving external electrodes 35 on the fixed end portion of the vibrator assembly 6 by soldering or the like. The contact point 42*a* of each common conductor 42 is electrically joined to an associated one of the common external electrodes 34 on the fixed end portion of the vibrator assembly 6 by soldering or the like.

On the surface of the flexible cable 8 on which the contact points 41*a* and 42*a* are provided, the controller IC 9 is mounted on the way of the drive conductor 41 and the common conductor 42. A face opposite to a face of the controller IC 9 mounted on the flexible cable 8 is abraded to make the thickness of the controller IC 9 identical with the thickness of the vibrator assembly 6. The abraded surface becomes a semiconductor face by removing an oxide film. As shown in FIG. 5, the abraded face of the controller IC 9 is bonded onto the IC bonding region 38 by an ultraviolet curing adhesive 43 which is one kind of photocuring adhesives. Since the IC bonding region 38 is uniformly coated by the resin film 39, the abraded face and the fixing plate 7 are electrically isolated from each other.

The adhesive 43 may be coated on a part of the abraded face to isolate the abraded face and the fixing plate 7. For example, the adhesive 43 may be coated on an outer peripheral portion of the abraded face, so that the coating amount of the adhesive 43 may be managed roughly to improve the manufacturing efficiency. When the photocuring adhesive is adopted, such an adhesive can be selectively coated on a portion to which light such as ultraviolet light is irradiated, so that the coated adhesive can be surely cured without remaining uncured portions.

The adhesive is not limited to the photocuring adhesive. For example, thermocuring adhesives or quick-drying adhesives may be adopted.

Figure 6A:
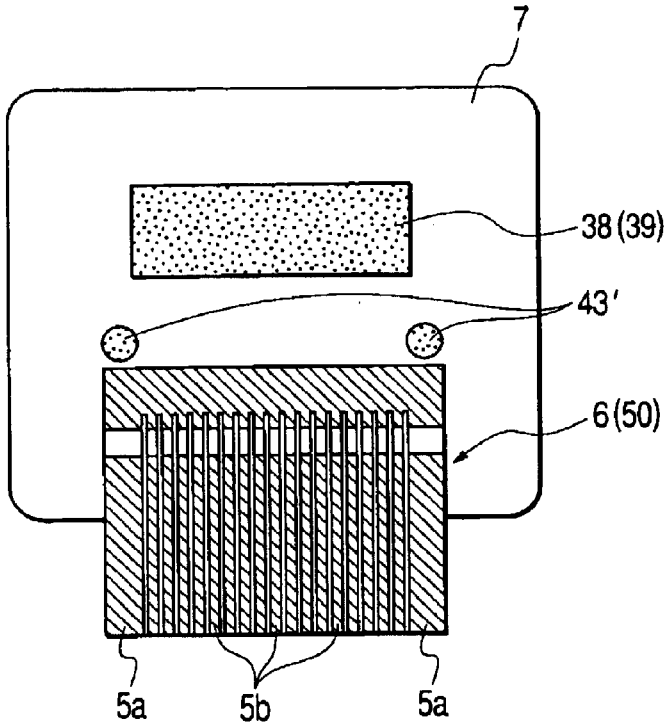
FIGS. 6A to 6C are views showing another way of bonding a flexible cable.
Figure 6B:
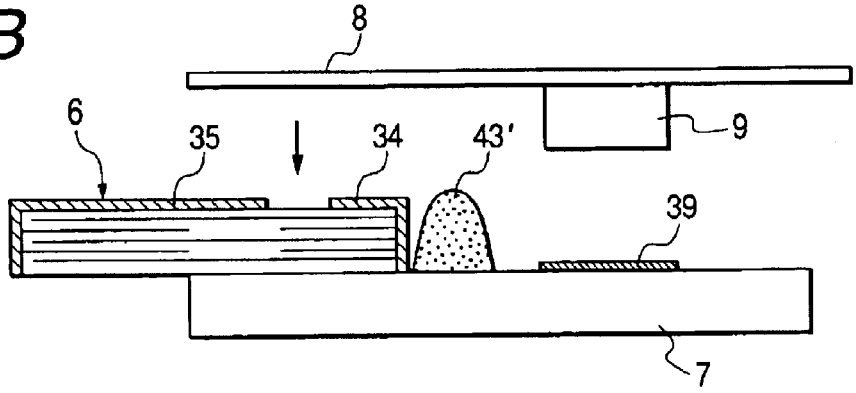
Figure 6C:
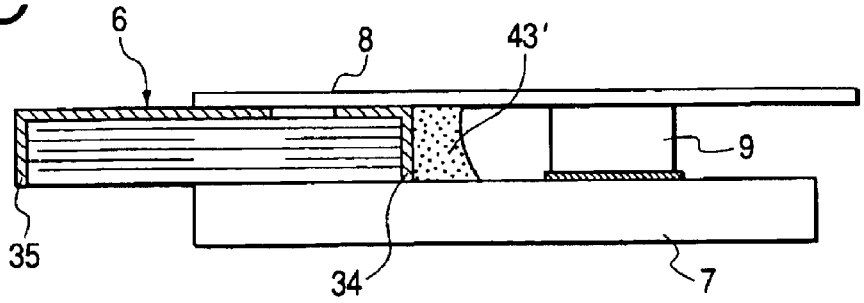

According to the above structure, furthermore, the abraded face and the fixing plate 7 are isolated without bonding the controller IC 9 and the fixing plate 7. As shown in FIGS. 6A to 6C, for example, the adhesive 43' is locally coated on a top face of the fixing plate 7 in the vicinity of corner portions of the fixed end portion of the vibrator assembly 6. After then, the flexible cable 8 is soldered onto the piezoelectric vibrators 5, while the abraded face of the controller IC 9 is placed on the resin film 39. Finally, the adhesive 43' is cured.

With this arrangement, the both widthwise end portions of the flexible cable 8 are bonded with the adhesive 43' at the vicinity of the soldering portions of the piezoelectric vibrators 5, so that the open circuit due to the peeling-off of the contacts 41*a* and 42*a* can be surely prevented.

Although the adhesive is coated on the fixing plate in this embodiment, the adhesive may be coated on the flexible cable to attain the same advantages.

When the drive signal is applied via the flexible cable 8, the potential of the drive signal is applied to the drive electrodes 31, and the bias potential is applied to the common electrodes 32. Accordingly, the voltage corresponding to the potential difference between the drive electrodes 31 and the common electrodes 32 is applied to the piezoelectric material 33 so that the piezoelectric material 33 deforms in accordance with the amplitude of the voltage to extend or contract the drive vibrator 5*b* in the longitudinal direction thereof.

Here, as described the above, there is possibility that the fixing plate 7 is charged by the bias voltage when the common external electrode 34 is directly contact the fixing plate 7. However, in this embodiment, the resin film 39 previously formed on the IC bonding region 38 isolates the controller IC 9 from the fixing plate 7. As a result, the abraded face of the controller IC 9 can be surely prevented from charging the bias potential, so that fault and malfunction of the controller IC 9 can be avoided.

Figure 7:
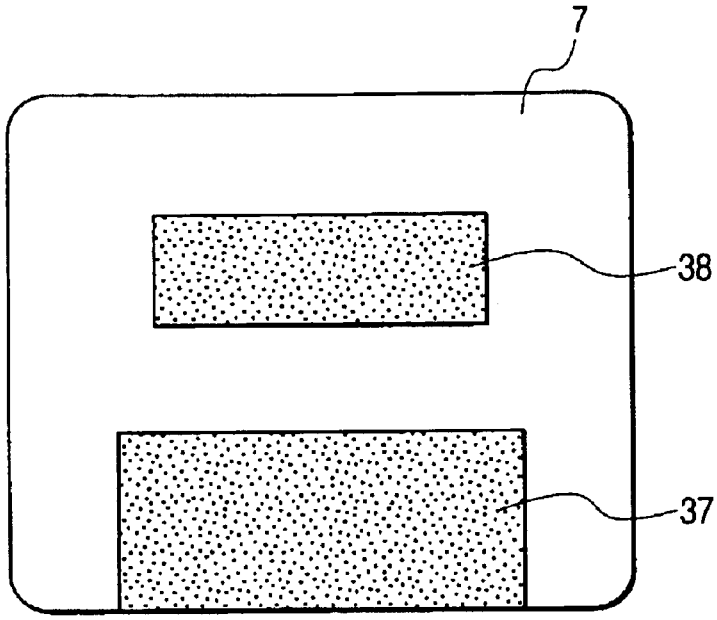
FIG. 7 is a plan view of a vibrator bonding region and an IC bonding region showing a state that no member is bonded thereon.

Next, how to manufacture the liquid jetting head 1 will be explained based on the manufacturing procedures of the vibrator unit 2. First, a fixing plate 7 having a predetermined size is prepared. Then, an adhesive is coated on one face of the fixing plate 7. Specifically, as shown in FIG. 7, the adhesive is coated on the vibrator bonding region 37 and the IC bonding region 38. Although any way of coating the adhesive can be adopted, care is required to coat the adhesive on the IC bonding region 38 without providing deficiency such as a pin hole. For the adhesive, an insulative adhesive such as thermosetting epoxy-group adhesive is preferably used.

Figure 8:
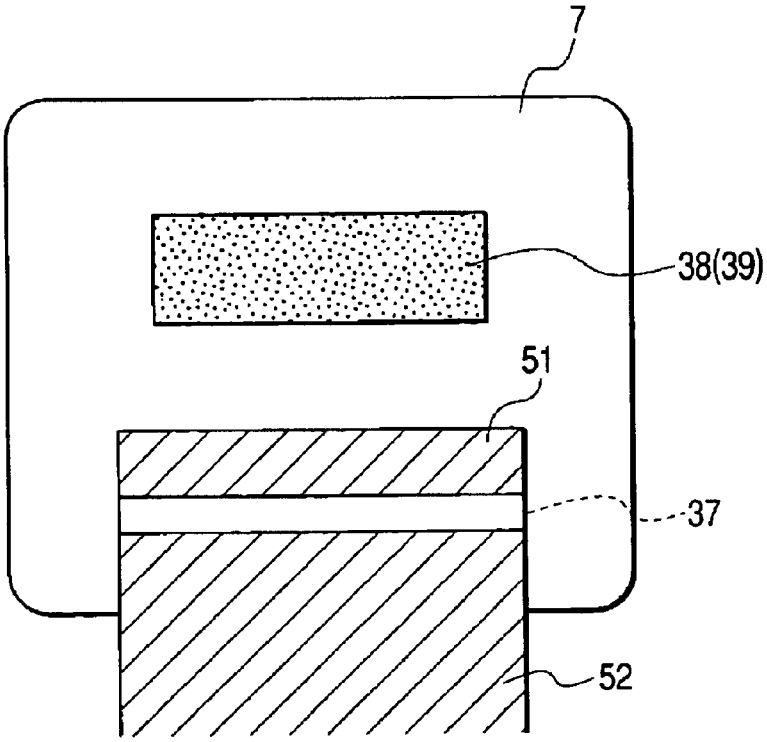
FIG. 8 is a plan view of the vibrator bonding region and the IC bonding region showing a state that a piezoelectric plate is bonded on the vibrator bonding region.

As shown in FIG. 8, a half part of a piezoelectric plate 50 is placed on the vibrator bonding region 37. The piezoelectric plate 50 is a base plate member of the vibrator assembly 6 (before being pectinated), in which electrode layers to be common electrodes 32 and electrode layers to be drive electrodes 31 are alternately laminated while sandwiching the piezoelectric material 33. On an outer face of the piezoelectric plate 50, an electrode layer 51 to be the common external electrode 34 and an electrode layer 52 to be the driving external electrode 35 are formed. After then, the adhesive coated on the vibrator bonding region 37 and the IC bonding region 38 is solidified to bond the piezoelectric plate 50 onto the fixing plate 7.

At the same time, the adhesive coated on the IC bonding region 38 is also solidified to be the resin film 39. That is, in this manufacturing method, the adhesive layer to be the resin film 39 is formed on the IC bonding region 38 when the adhesive is coated on the vibrator bonding region 37, an the adhesive layer is solidified to form the resin film 39 when the adhesive coated on the vibrator bonding region 37 is solidified. Therefore, the step of fixing the piezoelectric plate 50 to be the vibrator assembly 6 and the step of forming the resin film 39 are simultaneously performed, so that the vibrator unit 2 can be efficiently assembled. Further, since the resin film 39 is formed by coating the adhesive, an extremely thin film having no deficiency can be easily fabricated.

Figure 9:
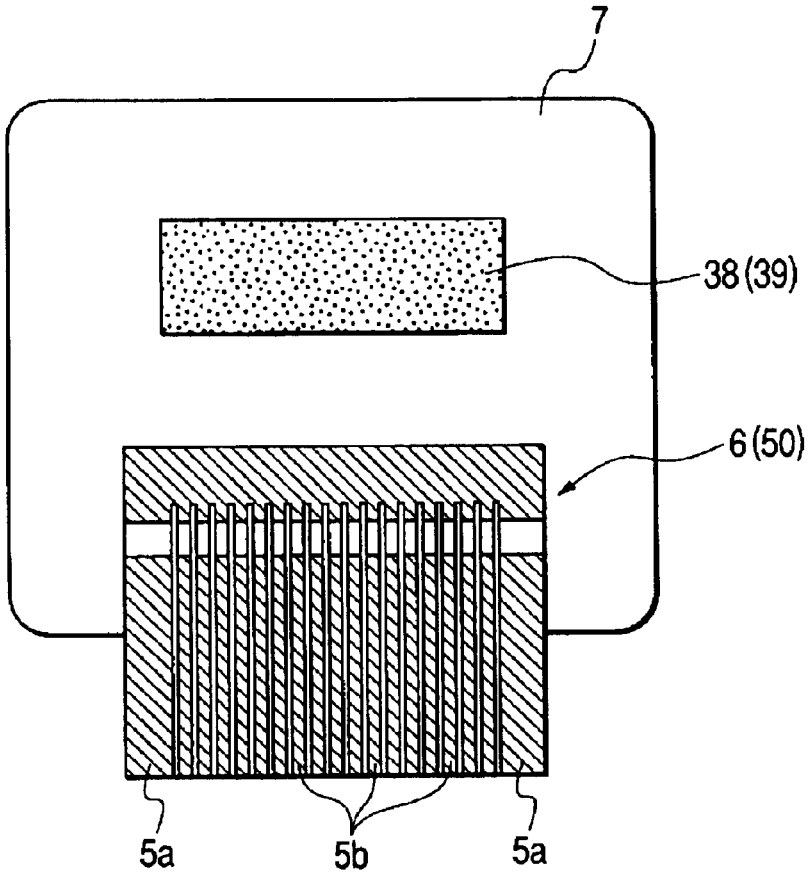
FIG. 9 is a plan view of the vibrator bonding region and the IC bonding region showing a state that the piezoelectric plate is pectinated to form a vibrator assembly.

After then, as shown in FIG. 9, the drive vibrators 5*b* and the dummy vibrators 5*a* are formed by pectinating the piezoelectric plate 50 by moving a dicing saw, a wire saw or the like from the free end side of the plate 50 toward the fixing plate 7. In this embodiment, although the plate 50 bonded to the fixing plate 7 is pectinated, the vibrator assembly 6 which has been pectinated may be bonded onto the fixing plate 7.

Figure 10:
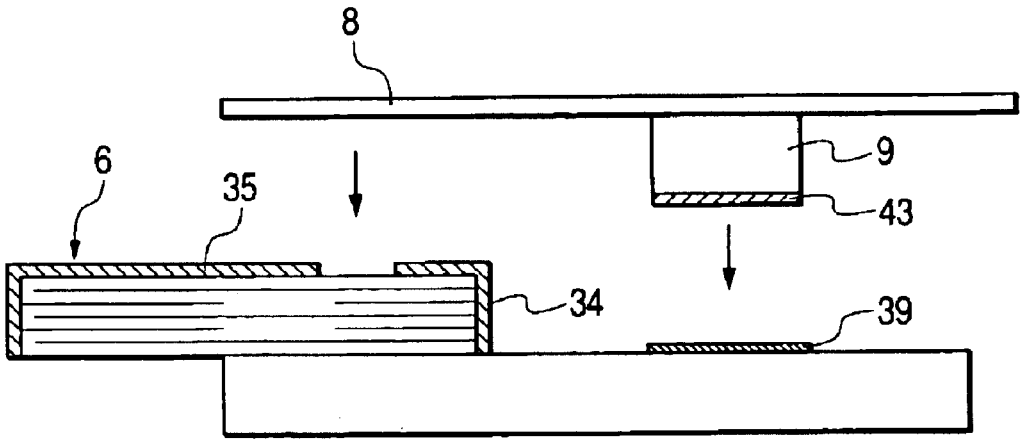
FIG. 10 is a side view showing a step of mounting a flexible cable and a controller IC are mounted on a fixing plate.

After then, the flexible cable 8 is joined to the outer face of the vibrator assembly 6. Specifically, as shown in FIG. 10, the contact portions 41*a* and 42*a* of the flexible cable 8 and the external electrodes 34 and 35 of the respective vibrators 5 are joined by soldering. Here, the ultraviolet curing adhesive 43 is coated on the abraded face of the controller IC 9, and the abraded face is placed on the resin film 39. The positions of the contact portions 41*a* and 42*a* with respect to the external electrodes 34 and 35 are determined, the adhesive 43 is exposed to ultraviolet light to be solidified, so that the controller IC 9 is bonded on the resin film 39.

Since the resin film 39 is previously formed at a portion where the controller IC 9 is to be bonded, the abraded face of the controller IC 9 can be prevented from directly contacting the fixing plate 7 even if the controller IC 9 is pressed against the fixing plate 7 in a condition that the adhesive 43 is unsolidified. Therefore, the fixing plate 7 and the controller IC 9 can be surely isolated.

Incidentally, as described the above, if the flexible cable 8 is bonded with the adhesive 43' onto the fixed end portion of the vibrator assembly 6 while the abraded face of the controller IC 9 is placed on the resin film 39 formed in the IC bonding region 38, the fixing plate 7 and the controller IC 9 are isolated without bonding the abraded face onto the resin film 39.

The assembled vibrator unit 2 is then accommodated and fixed in the case 3. In this step, the channel unit 4, which has been separately fabricated, is first bonded onto a channel unit-side end face of the case 3, and then the vibrator unit 2 is inserted into the chamber 10. To perform this insertion, an adhesive is first coated on the respective free end faces of the vibrators 5, and the free end faces are directed toward the channel unit 4. During this operation, since the controller IC 9 is bonded onto the fixing plate 7, the flexible cable 8 is hardly separated from the fixing plate 7, so that the insertion is facilitated. The same advantages can be attained by the configuration as shown in FIGS. 6A to 6C because the flexible cable 8 is firmly bonded onto the vibrator assembly 6 with the adhesive 43'.

When the free end faces of the vibrators 5 are abutted onto the island portions 24, a liquid adhesive is injected into a gap between a back face of the fixing plate 7 opposite to the face on which the vibrator assembly 6 is mounted and an inner wall face of the chamber 10 opposing to the back face. This adhesive is a low-viscous thermosetting adhesive. An epoxy-group adhesive is preferably adopted as the adhesive. The injected adhesive extends within the gap due to the capillary force. When the bonding region is filled with the injected adhesive, it is solidified.

After the bonding fixation of the vibrator unit 2 is completed, a wiring board or the like is mounted to complete the assembly of the liquid jetting head 1.

The above configurations described with reference to one preferred embodiment can be modified or changed within the scope defined by the appended claims.

For example, in the above embodiment, although the resin film 39 is formed on the IC bonding region 38 on the fixing plate 7, such an insulating layer may be formed on the abraded face of the controller IC 9. In other words, it is essential that the insulating layer is interposed between the abraded face of the controller IC 9 and the fixing plate 7. In such a case, an extremely thin insulating sheet may be adhered on the abraded face of the controller IC 9 so that the controller IC 9 provided with the insulating sheet is bonded onto the fixing plate 7. This process can be easily realized.

The wiring board is not limited to the flexible cable 8. It is essential that the wiring board is provided as a flexible sheet-shaped member. For example, it may be provided as a tip-on-film member wherein the controller IC 9 (controller chip) is mounted on a wiring film in which conductors are sandwiched by a pair of insulating films.

The process for reducing the thickness of the controller IC 9 is not limited to the abrasion. Cutting or the like may be arbitrarily adopted.

The resin film 39 may be formed by an adhesive containing a filler.

The descriptions have been made for the ink jet recording head as an example of the liquid jetting head. The present invention is applicable to any other liquid jetting heads. For example, it is applicable for a coloring material jetting head and an electrode material jetting head used for manufacturing a liquid crystal display, an EL display, an FED (field emission display), and so on. It is applicable for a bio-organic substance jetting head used for manufacturing a bio-chip, and for a micro pipette (a sample jetting head).

What is claimed is:

1. A liquid jetting head, comprising:

a fixing plate, including a first region and a second region;

a vibrator assembly, including a plurality of piezoelectric vibrators, a drive electrode formed on each of the piezoelectric vibrators, and a common electrode formed commonly to the piezoelectric vibrators, the vibrator assembly bonded onto the first region in a cantilevered manner;

a sheet-shaped wiring board, which supplies a drive signal to the drive electrode and applies a bias potential which is higher than a ground potential to the common electrode;

a controller IC, which controls the drive signal, the controller IC having a first face mounted on the wiring board, and a second face opposing to the first face in which a semiconductor surface is exposed; and an insulating layer, interposed between the second region of the fixing plate and the second face of the controller IC.

2. The liquid jetting head as set forth in claim 1, wherein the insulating layer is a resin film formed on the second region of the fixing plate.

3. The liquid jetting head as set forth in claim 2, wherein the resin film is formed by an adhesive used for bonding the vibrator assembly and the fixing plate.

4. The liquid jetting head as set forth in claim 1, wherein the insulating layer is a resin sheet adhered on the second face of the controller IC.

* * * * *